US007528738B1

(12) United States Patent
Garrett, Sr.

(10) Patent No.: US 7,528,738 B1
(45) Date of Patent: May 5, 2009

(54) ELECTRONIC VERTICAL CLEARANCE ADVERTISEMENT SAFETY SYSTEM

(75) Inventor: Richard C. Garrett, Sr., Tucson, AZ (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/184,011

(22) Filed: Jul. 31, 2008

(51) Int. Cl.
*G08G 1/09* (2006.01)

(52) U.S. Cl. ..... 340/905; 340/425.5; 116/67 R

(58) Field of Classification Search ..... 340/905, 340/907, 425.5, 435; 116/67 R
See application file for complete search history.

(56) References Cited

U.S. PATENT DOCUMENTS

2004/0201495 A1 10/2004 Lim et al.

*Primary Examiner*—Daniel Wu
*Assistant Examiner*—Hongmin Fan
(74) *Attorney, Agent, or Firm*—Wenderoth, Lind & Ponack, L.L.P.

(57) ABSTRACT

A method includes electronically advertising structural clearance information of overpasses to an oncoming vehicle so as to determine a continued route of the vehicle. Each of the overpasses includes a transceiver. The transceiver of each overpass other than a final overpass sequentially transmits information to the transceiver of a nearest respective overpass in a direction facing the vehicle. The transceiver of an initial overpass transmits information which includes a minimum vertical clearance beneath the initial overpass. The transceiver of each overpass other than the initial overpass compares a minimum vertical clearance beneath its corresponding overpass with a minimum vertical clearance received from the transceiver of a respective preceding overpass and determines a lowest minimum vertical clearance. The transceiver of the final overpass transmits information to the oncoming vehicle. The information transmitted from the transceiver of each overpass other than the initial overpass includes the lowest minimum vertical clearance determined by the corresponding transceiver.

1 Claim, 2 Drawing Sheets

ELECTRONIC VERTICAL CLEARANCE ADVERTISEMENT SAFETY SYSTEM

FIELD OF THE INVENTION

A method of electronically advertising structural clearance information of an overpass to a vehicle.

BACKGROUND OF THE INVENTION

An elevated overpass extending across a freeway, waterway or railway transportation system requires that only vehicles with adequate clearances attempt to pass beneath. If a vehicle attempts to navigate under an overpass for which it exceeds the maximum vehicle height, a collision is likely to occur.

In order to avoid such collisions, many overpasses include signs to warn vehicle operators of the maximum height limitations of the overpasses. Other overpasses include active warning systems near the overpass, such as flashing lights or audio warnings, which notify an operator that their vehicle exceeds the maximum vehicle height to pass beneath the overpass. In warning systems such as these, collisions may occur because vehicle operators fail to notice warning signs or are warned in too close a proximity to the overpass.

A method of electronically advertising structural clearance information of an overpass to a vehicle provides a warning system which warns vehicle operators of potential collisions far in advance of the location where the collision might occur.

SUMMARY OF THE INVENTION

According to an embodiment of the invention, a method includes electronically advertising structural clearance information of a plurality of overpasses to an oncoming vehicle so as to determine a continued route of the vehicle. Each of the overpasses includes a transceiver, and the plurality of overpasses includes at least an initial overpass which is farthest of the overpasses from the vehicle and a final overpass which is closest of the overpasses to the vehicle.

In an embodiment of the invention, the transceiver of each overpass other than the final overpass sequentially transmits structural clearance information to the transceiver of a nearest respective overpass in a direction facing the oncoming vehicle. Further, the transceiver of the initial overpass transmits structural clearance information which includes a minimum vertical clearance beneath the initial overpass.

The transceiver of each overpass other than the initial overpass compares a minimum vertical clearance beneath its corresponding overpass with a minimum vertical clearance received from the transceiver of a respective preceding overpass so as to determine a lowest minimum vertical clearance.

The transceiver of the final overpass transmits structural clearance information to the oncoming vehicle. In an embodiment of the invention, the transceiver of each overpass other than the initial overpass transmits structural clearance information which includes the lowest minimum vertical clearance determined by the corresponding transceiver.

Further, in an embodiment of the invention, a transceiver of the oncoming vehicle receives the transmitted structural clearance information from the transceiver of the final overpass and determines whether a maximum height of the vehicle exceeds a lowest minimum vertical clearance of the plurality of overpasses. Using this determination, the transceiver of the oncoming vehicle thereby determines the continued route of the vehicle.

BRIEF DESCRIPTION OF THE FIGURES

In the drawings, like reference numbers generally indicate identical, functionally similar and/or structurally similar elements. Embodiments of the invention will be described with reference to the accompanying drawings, wherein.

DETAILED DESCRIPTION OF THE INVENTION

Figure 1:
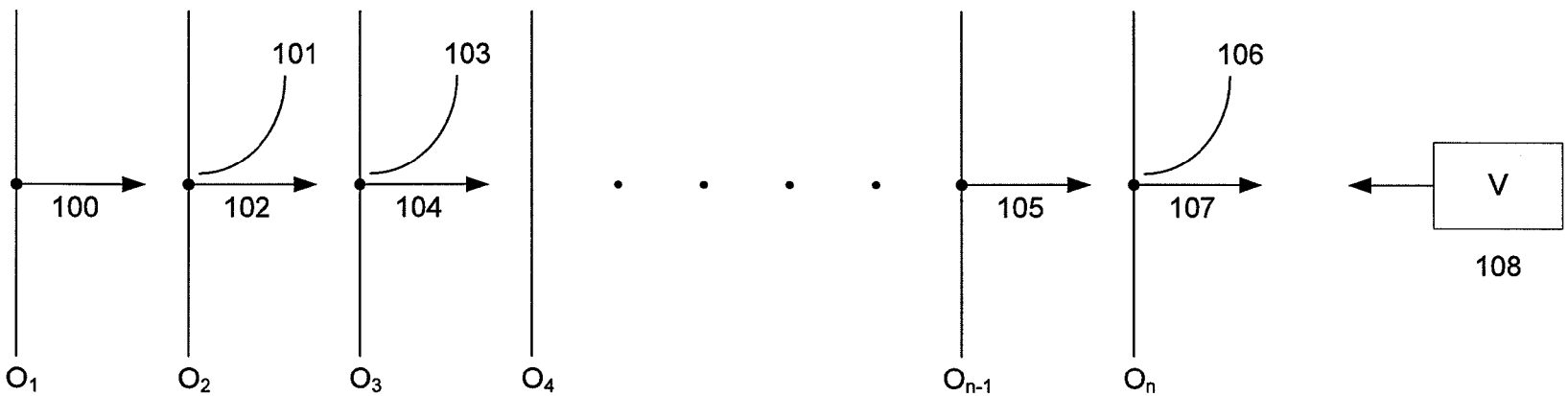
FIG. 1 is a flowchart illustrating an exemplary method of electronically advertising structural clearance information in accordance with an embodiment of the present invention.

FIG. 1 illustrates an exemplary method of advertising structural clearance information of a plurality of overpasses to an oncoming vehicle in accordance with an embodiment of the invention. In this embodiment, at step 100, a transceiver on an overpass which is farthest from the oncoming vehicle (overpass $O_1$) transmits structural clearance information of the overpass $O_1$ to a transceiver of the next overpass in the direction toward the oncoming vehicle (overpass $O_2$). The structural clearance information includes the maximum height a vehicle can have in order to pass safely beneath the particular overpass (i.e., a minimum vertical clearance beneath the overpass). The structural clearance information may be in the form of a radio frequency (RF) signal.

At step 101, the transceiver of the overpass $O_2$ compares the minimum vertical clearance of the overpass $O_1$ with a minimum vertical clearance for the overpass $O_2$, and determines the lowest minimum vertical clearance of the overpasses $O_1$ and $O_2$. At step 102, the transceiver of the overpass $O_2$ transmits structural clearance information which includes the lowest minimum vertical clearance from step 101 to a transceiver of the next overpass in the direction toward the oncoming vehicle (overpass $O_3$).

At step 103, the transceiver of the overpass $O_3$ compares the lowest minimum vertical clearance received from the overpass $O_2$ with a minimum vertical clearance for the overpass $O_3$, and determines the lowest minimum vertical clearance thereof. At step 104, the transceiver of the overpass $O_3$ transmits structural clearance information which includes the lowest minimum vertical clearance from step 103 to a transceiver of the next overpass in the direction toward the oncoming vehicle (overpass $O_4$).

The process shown in steps 103 and 104 continues for each subsequent overpass in the direction toward the oncoming vehicle until step 105, at which a transceiver of the overpass which is closest to the oncoming vehicle (overpass $O_n$) receives a lowest minimum vertical clearance from the transceiver of the preceding overpass (overpass $O_{n-1}$). At step 106, the transceiver of the overpass closest to the oncoming vehicle (overpass $O_n$) compares the lowest minimum vertical clearance received from the preceding overpass (overpass $O_{n-1}$) with a minimum vertical clearance for the overpass $O_n$, and determines the lowest minimum vertical clearance thereof, thereby determining the lowest minimum vertical clearance of the plurality of overpasses. At step 107, the transceiver of the overpass $O_n$ repeatedly transmits structural clearance information which includes the lowest minimum vertical clearance of the plurality of overpasses from step 106 to a transceiver device in an oncoming vehicle.

At step 108, a transceiver of an on-board unit in the oncoming vehicle receives the structural clearance information including the lowest minimum vertical clearance of the plurality of overpasses. The on-board unit compares the lowest minimum vertical clearance of the plurality of overpasses with the maximum height of the vehicle at step 109. If the vehicle height exceeds the lowest minimum vertical clearance of the plurality of overpasses, the on-board unit issues a warning to the operator that the upcoming group of overpasses includes at least one overpass which the vehicle will collide with, at step 110. If the vehicle height is less than the lowest minimum vertical clearance of the plurality of overpasses, no warning is issued, and the vehicle may proceed to pass safely beneath the overpasses, at step 111.

For example, if a vehicle having a height of 12 ft is approaching a group of four overpasses $O_1$, $O_2$, $O_3$ and $O_4$ having minimum vertical clearances of 15 ft, 13 ft, 10 ft and 11 ft, respectively, the method described above would be carried out in the following manner. At step 100, the transceiver on overpass $O_1$ (which is farthest from the oncoming vehicle) transmits structural clearance information to the transceiver of overpass $O_2$. The structural clearance information includes the minimum vertical clearance of 15 ft for overpass $O_1$.

At step 101, the transceiver of overpass $O_2$ compares the minimum vertical clearance of overpass $O_1$ (15 ft) with the minimum vertical clearance for overpass $O_2$ (13 ft), and determines that 13 ft is the lowest minimum vertical clearance of overpasses $O_1$ and $O_2$. At step 102, the transceiver of overpass $O_2$ transmits structural clearance information which includes the lowest minimum vertical clearance of 13 ft to the transceiver of overpass $O_3$.

At step 103, the transceiver of overpass $O_3$ compares the lowest minimum vertical clearance received from overpass $O_2$ (13 ft) with the minimum vertical clearance for overpass $O_3$ (10 ft), and determines that 10 ft is the lowest minimum vertical clearance of overpasses $O_1$, $O_2$ and $O_3$. At step 104, the transceiver of overpass $O_3$ transmits structural clearance information which includes the lowest minimum vertical clearance of 10 ft to the transceiver of overpass $O_4$.

At step 105, the transceiver of overpass $O_4$ (the overpass closest to the oncoming vehicle in this example) receives the lowest minimum vertical clearance from the transceiver of the preceding overpass $O_3$. At step 106, the transceiver of overpass $O_4$ compares the lowest minimum vertical clearance received from overpass $O_3$ (10 ft) with the minimum vertical clearance for overpass $O_4$ (11 ft), and determines that 10 ft is the lowest minimum vertical clearance of the group of overpasses. At step 107, the transceiver of overpass $O_4$ repeatedly transmits structural clearance information which includes the lowest minimum vertical clearance of the plurality of overpasses (10 ft) to a transceiver of an oncoming vehicle.

At step 108, a transceiver of the on-board unit of the oncoming vehicle receives the structural clearance information which indicates that the lowest minimum vertical clearance of the plurality of overpasses is 10 ft. At step 109, the on-board unit compares the lowest minimum vertical clearance (10 ft) with the maximum height of the vehicle (12 ft). In this example, because the vehicle height exceeds the lowest minimum vertical clearance of the plurality of overpasses, the on-board unit issues a warning to the operator that the upcoming group of overpasses includes at least one overpass which the vehicle will collide with, at step 110.

In the example described above, the plurality of overpasses includes four overpasses. However, the example is provided for illustrative purposes only, and the number of overpasses in the embodiments of the invention is not limited by the example described above.

In the embodiment described above, the structural clearance information of a particular overpass may include the maximum weight a vehicle can have in order to pass safely over the particular overpass. In another embodiment, the on-board unit compares a lowest maximum vehicle weight of the plurality of overpasses with a maximum weight of the vehicle.

In another embodiment of the invention, transceivers on the overpasses advertise structural clearance information of the overpasses in two directions of approaching vehicles.

Figure 2:
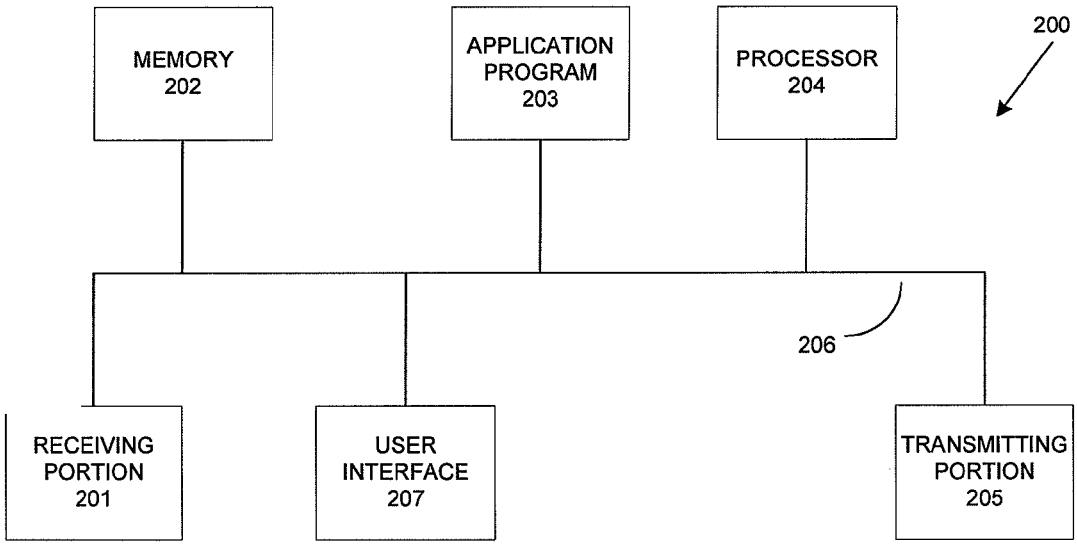
FIG. 2 is a block diagram of an exemplary transceiver used to perform the electronic advertising method of FIG. 1.

FIG. 2 illustrates a representative transceiver for performing the method of electronically advertising structural clearance information of FIG. 1. In FIG. 2, the transceiver 200 includes a receiving portion 201, a memory 202, an application program 203, processor 204, transmitting portion 205, bus 206 and user interface 207. In the transceiver 200, the receiving portion 201 receives radio frequency (RF) signals containing structural clearance information through an antenna (not shown), and the transmitting portion 205 transmits RF signals containing structural clearance information through an antenna (not shown).

The memory 202 can be computer-readable media used to store executable instructions, or a computer program thereon. The memory 202 may include ROM, RAM, PROM, EPROM, smart card, SIMs, WIMs or any other medium from which a computing device can read executable instructions or a computer program. The term "computer program" is intended to encompass an executable program that exists permanently or temporarily on any computer-readable medium.

The executable instructions or computer program stored in the memory 202 are executable by one or more processors 204, which may be facilitated by one or more of the application programs 203. The application programs 203 may also include, but are not limited to, an operating system or any special computer program that manages the relationship between application software and any suitable variety of hardware that helps to make-up a computer system or computing environment. The executable instructions or computer programs stored in the memory 202 also causes the transceiver to perform the comparison of a lowest minimum vertical clearance included in a received RF signal with a minimum vertical clearance of an overpass on which the transceiver 200 may be located, as described in detail in the discussion of FIG. 1. General communication between the components in the transceiver 200 is provided via the bus 206.

The user interface 207 allows interaction between a user and the transceiver 200. The user interface 207 may include a keypad, a keyboard, microphone, a display and/or speakers. In one embodiment of the invention, a user may input structural clearance information (including the minimum vertical clearance) of an overpass on which the transceiver 200 is located to the memory 202 via the user interface 207. In another embodiment, the memory 202 may include a self-setting algorithm which is executable in order to determine the minimum vertical clearance of an overpass on which the transceiver 200 is located by "sweeping" the topography below the overpass. In another embodiment, a satellite (not shown) transmits structural clearance information (including the minimum vertical clearance) of an overpass on which the transceiver 200 is located to the memory 202 via the receiving portion 201. In yet another embodiment, a user may input structural clearance information which includes the lowest minimum vertical clearance of a plurality of overpasses to the memory 202 of a transceiver 200 located on any of the overpasses.

In another embodiment, a transceiver 200 is also incorporated in an on-board unit of an oncoming vehicle. In such an embodiment, the executable instructions or computer programs stored in the memory 202 also causes the transceiver to perform the comparison of a lowest minimum vertical clearance included in a received RF signal with a maximum height of the vehicle on which the on-board unit may be located, as described in detail in the discussion of FIG. 1. In another embodiment, the executable instructions or computer programs stored in the memory 202 also causes the on-board unit to issue an audible and/or visible warning to the driver if the maximum height of the vehicle exceeds the lowest minimum vertical clearance included in the received RF signal.

In a further embodiment of the invention, the driver may input vehicle measurement information (including the maximum vehicle height) to the memory 202 via the user interface 207 of the transceiver in the on-board unit. In another embodiment, the receiving portion 201 of the on-board unit receives the vehicle measurement information from a signal sent by a measurement station (not shown) which determines the vehicle measurement information as the vehicle moves past the measurement station, and the memory 202 stores the vehicle measurement information. In such an embodiment, the executable instructions or computer programs stored in the memory 202 of the on-board unit includes a communications protocol having a set of commands that can be exchanged between the measurement station, the transceiver of the on-board unit, and the transceiver of a respective overpass.

In another embodiment, the transmitting portion 205 of the on-board unit transmits tracking information stored in the memory 202. The tracking information may include, but is not limited to, vehicle identification information and cargo identification information.

In a further embodiment of the invention, the structural clearance information of a particular overpass may include the maximum weight a vehicle can have in order to pass safely over the particular overpass. In such an embodiment, the vehicle measurement information stored in the memory 202 of the on-board unit includes the maximum weight of the vehicle, and the executable instructions or computer programs stored in the memory 202 also causes the on-board unit to perform a comparison of a lowest maximum vehicle weight of the plurality of overpasses included in a received RF signal with a maximum weight of the vehicle on which the on-board unit may be located. In another embodiment, the executable instructions or computer programs stored in the memory 202 also causes the on-board unit to issue an audible and/or visible warning to the driver if the maximum weight of the vehicle exceeds the lowest maximum vehicle weight included in the received RF signal.

In another embodiment, the on-board unit of the vehicle may also include a GPS unit. In such an embodiment, the executable instructions or computer programs stored in the memory 202 of the on-board unit also causes the GPS unit to determine an alternate route which avoids a particular overpass if the maximum height of the vehicle exceeds the minimum vertical clearance of the particular overpass included in the received RF signal.

Additionally, it should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A method of electronically advertising structural clearance information of a plurality of overpasses to an oncoming vehicle so as to determine a continued route of the vehicle, each of the overpasses having a transceiver arranged thereon, the plurality of overpasses including at least an initial overpass which is farthest of the overpasses from the vehicle and a final overpass which is closest of the overpasses to the vehicle, the method comprising:

sequentially transmitting structural clearance information from the transceiver of each overpass other than the final overpass to the transceiver of a nearest respective overpass in a direction facing the oncoming vehicle, wherein the structural clearance information transmitted from the transceiver of the initial overpass includes a minimum vertical clearance beneath the initial overpass;

comparing, at the transceiver of each overpass other than the initial overpass, a minimum vertical clearance beneath its corresponding overpass with a minimum vertical clearance received from the transceiver of a respective preceding overpass so as to determine a lowest minimum vertical clearance; and transmitting structural clearance information from the transceiver of the final overpass to the oncoming vehicle, wherein the structural clearance information transmitted from the transceiver of each overpass other than the initial overpass includes the lowest minimum vertical clearance determined by the corresponding transceiver, and wherein a transceiver of the oncoming vehicle receives the transmitted structural clearance information from the transceiver of the final overpass for determining whether a maximum height of the vehicle exceeds a lowest minimum vertical clearance of the plurality of overpasses to thereby determine the continued route of the vehicle.

* * * * *